US006722779B2

(12) United States Patent
Henderson et al.

(10) Patent No.: US 6,722,779 B2
(45) Date of Patent: Apr. 20, 2004

(54) CONSTANT PRECISION VOLUMETRIC DILUTION VESSEL

(75) Inventors: William B. Henderson, Auburn, CA (US); Dean S. Waldon, Antelope, CA (US)

(73) Assignee: Polypros Inc., Roseville, CA (US)

( * ) Notice: Subject to any disclaimer, the term of this patent is extended or adjusted under 35 U.S.C. 154(b) by 244 days.

(21) Appl. No.: 10/045,580

(22) Filed: Oct. 26, 2001

(65) Prior Publication Data

US 2003/0081496 A1 May 1, 2003

(51) Int. Cl.[7] ..... B01F 15/04

(52) U.S. Cl. ..... 366/143; 366/136; 366/152.2; 366/152.6; 366/153.1; 366/162.1

(58) Field of Search ..... 366/134, 136–137, 366/143, 152.1, 152.2, 152.6, 160.1, 160.2, 162.1, 153.1; 73/323

(56) References Cited

U.S. PATENT DOCUMENTS 3,713,338 A * 1/1973 Kind ..... 73/323
3,976,087 A * 8/1976 Bolton et al.
5,484,336 A * 1/1996 McConnell ..... 73/323
5,750,440 A 5/1998 Vanell et al.
6,287,192 B1 9/2001 Kim et al.
6,361,202 B1 * 3/2002 Lee et al. ..... 366/165.2
2003/0031086 A1 * 2/2003 Shikami et al. ..... 366/160.2

FOREIGN PATENT DOCUMENTS

EP 0381894 * 8/1990

* cited by examiner

*Primary Examiner*—Charles E. Cooley
(74) *Attorney, Agent, or Firm*—Knobbe, Martens, Olson & Bear, LLP

(57) ABSTRACT

A chemical delivery apparatus is provided. In one exemplary arrangement, the apparatus comprises a first vessel having a body and a neck extending upwardly from the body. The neck has a smaller cross-sectional area than the body. A fluid inlet is provided near a top of the neck. A fluid outlet is provided near a bottom of the body. A first sight tube port is provided near the top of the neck, and a second sight tube port is provided near the bottom of the body. A sight tube is connected between the first and second sight tube ports to indicate an amount of fluid in the first vessel. A first fluid source selectively communicates with the first vessel through the fluid inlet of the first vessel. A second vessel is also provided, comprising a fluid inlet and a fluid outlet. A second fluid source selectively communicates with the second vessel through the fluid inlet of the second vessel. A mix chamber selectively communicates with the first and second vessels through the fluid outlets of the first and second vessels.

12 Claims, 4 Drawing Sheets

CONSTANT PRECISION VOLUMETRIC DILUTION VESSEL

BACKGROUND OF THE INVENTION

1. Field of the Invention

The present invention relates generally to methods and apparatus for mixing chemicals used in semiconductor manufacturing processes and, more particularly, to methods and apparatus for mixing chemicals for use in chemical mechanical polishing processes.

2. Description of the Related Art

Chemical mechanical polishing (CMP) planarization techniques are commonly used in the manufacture of layered semiconductor devices. In typical CMP processes, a workpiece or wafer to be polished is pressed against a polishing pad under controlled conditions in the presence of a chemical mixture. The chemical mixture typically comprises a slurry including small, abrasive particles that abrade the surface of the wafer, and chemicals that etch and/or oxidize the surface of the wafer. When the pad and the wafer are moved with respect to one another, material is chemically and mechanically removed from the surface of the wafer to produce a polished or planarized surface.

Chemical mixtures used in CMP processes vary depending on the material to be removed from the surface of the wafer. If a metal surface is to be polished, the mixture may comprise, for example, a slurry containing a suspension of electrically charged alumina or silica particles and an oxidizer comprising, for example, hydrogen peroxide. If a nonmetal surface is to be polished, the mixture may comprise, for example, a slurry containing a suspension of electrically charged silica particles and, for example, ammonia or ammonium hydroxide.

In order to ensure consistent process results between wafers, it is necessary to precisely control the composition of the chemical mixture used. Prior art CMP systems typically include volumetric pumps that pump the various components of the mixture from bulk sources to a mix chamber where the components are mixed together. While typically providing high throughput, such systems typically do not allow precise control of the mixture composition due to the limited precision of the volumetric pumps. Accordingly, a need exists for a CMP system in which the composition of the chemical mixture delivered to the wafer can be precisely controlled without adversely affecting throughput.

SUMMARY OF THE INVENTION

In accordance with one aspect of the present invention, a method of preparing a fluid mixture comprising predetermined amounts of two or more fluids is provided. The method comprises the steps of providing a first vessel having a body and a neck extending upwardly from the body. The neck has a smaller cross-sectional area than the body. A first fluid is delivered to the first vessel to fill the body and at least a portion of the neck. A sight tube indicating an amount of the first fluid in the first vessel is read, preferably by an optical sensor. The delivery of the first fluid is discontinued when the sight tube indicates that a predetermined amount of the first fluid is in the first vessel. A second vessel is also provided. A second fluid is delivered to the second vessel. A sight tube indicating an amount of the second fluid in the second vessel is read, also preferably by an optical sensor. The delivery of the second fluid is discontinued when the sight tube indicates that a predetermined amount of the second fluid is in the second vessel. The predetermined amounts of the first and second fluids are then delivered to a mix chamber and mixed.

In accordance with another aspect of the present invention, a chemical delivery apparatus is provided, comprising a first vessel having a body and a neck extending upwardly from the body. The neck has a smaller cross-sectional area than the body. A fluid inlet is provided near a top of the neck. A fluid outlet is provided near a bottom of the body. A first sight tube port is provided near the top of the neck, and a second sight tube port is provided near the bottom of the body. A sight tube is connected between the first and second sight tube ports to indicate an amount of fluid in the first vessel. A first fluid source selectively communicates with the first vessel through the fluid inlet of the first vessel. A second vessel is also provided, comprising a fluid inlet and a fluid outlet. A second fluid source selectively communicates with the second vessel through the fluid inlet of the second vessel. A mix chamber selectively communicates with the first and second vessels through the fluid outlets of the first and second vessels.

In accordance with another aspect of the present invention, a method of preparing a fluid mixture comprising predetermined amounts of two or more fluids is provided. The method comprises the steps of providing a vessel having a body and a neck extending downwardly from the body. The neck has a smaller cross-sectional area than the body. A first fluid is delivered to the vessel to fill a portion of the neck. A sight tube indicating an amount of the fluid in the vessel is read, preferably by an optical sensor. The delivery of the first fluid is discontinued when the sight tube indicates that a predetermined amount of the first fluid is in the vessel. A second fluid is then delivered to the vessel to fill a remaining portion of the neck and at least a portion of the body. The sight tube is read by the optical sensor, and the delivery of the second fluid is discontinued when the sight tube indicates that a predetermined amount of the second fluid is in the vessel. The predetermined amounts of the first and second fluids are then delivered to a storage chamber.

In accordance with another aspect of the present invention, a chemical delivery apparatus is provided, comprising a vessel having a body and a neck extending downwardly from the body. The neck has a smaller cross-sectional area than the body. First and second fluid inlets are provided near a top of the body. A fluid outlet is provided near a bottom of the neck. A first sight tube port is provided near the top of body, and a second sight tube port is provided near the bottom of the neck. A first fluid source selectively communicates with the vessel through the first fluid inlet. A second fluid source selectively communicates with the vessel through the second fluid inlet. A sight tube connected between the first and second sight tube ports indicates an amount of fluid in the vessel. A storage chamber selectively communicates with the vessel through the fluid outlet.

DETAILED DESCRIPTION OF THE PREFERRED EMBODIMENT

Figure 1:
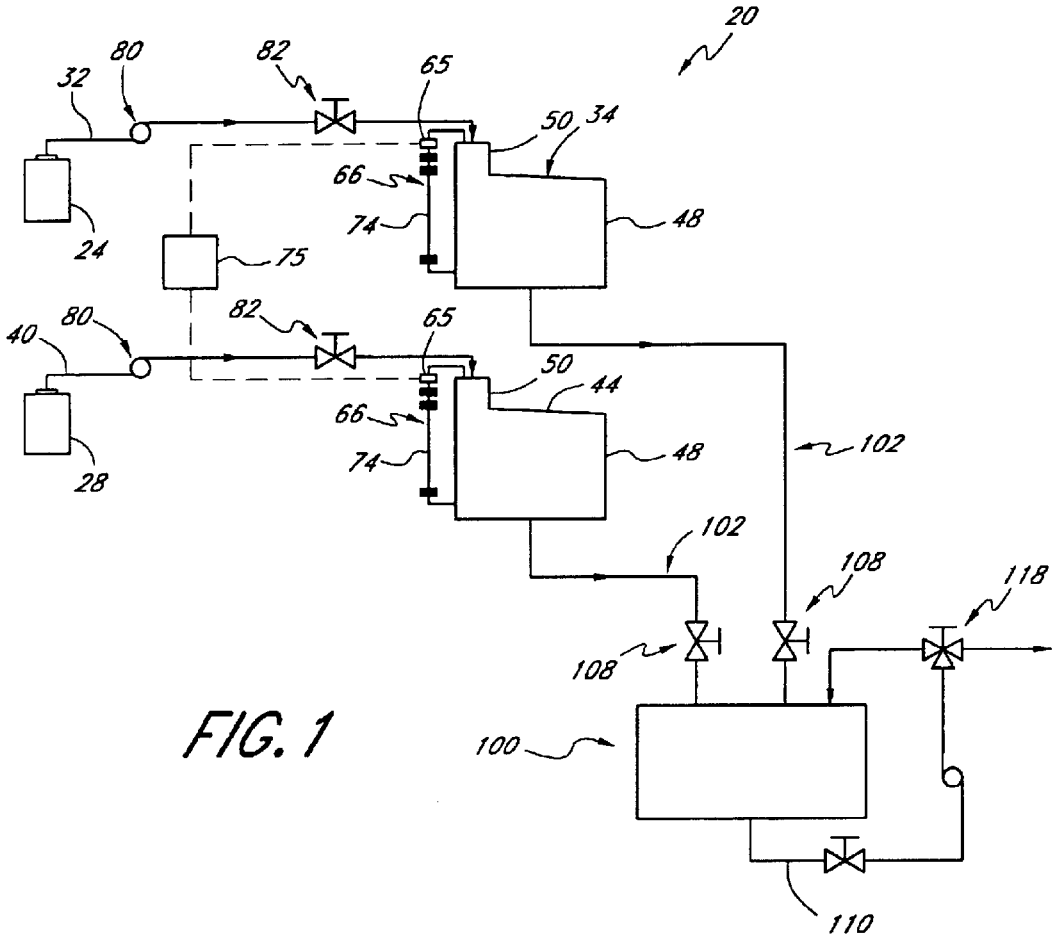
FIG. 1 is a simplified schematic view of a first exemplary apparatus for mixing chemical slurries for chemical mechanical polishing of a workpiece.

With reference to FIG. 1, an apparatus for preparing a chemical mixture for use in CMP processing of semiconductor wafers is illustrated and designated generally by the reference number 20. In the illustrated embodiment, the apparatus 20 comprises a first fluid source 24 and a second fluid source 28. Depending on the surface material to be polished, the first fluid source 24 may comprise, for example, a slurry containing a suspension of electrically charged alumina particles. The second fluid source 28 may comprise, for example, hydrogen peroxide.

Figure 4:
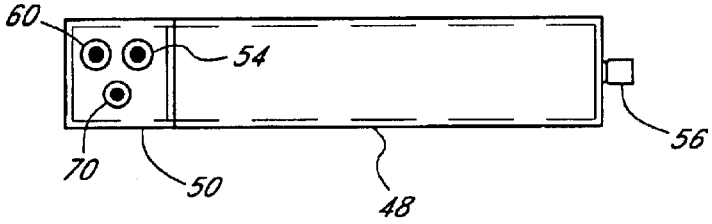
FIG. 4 is a top plan view of the vessel of FIG. 2.
Figure 2:
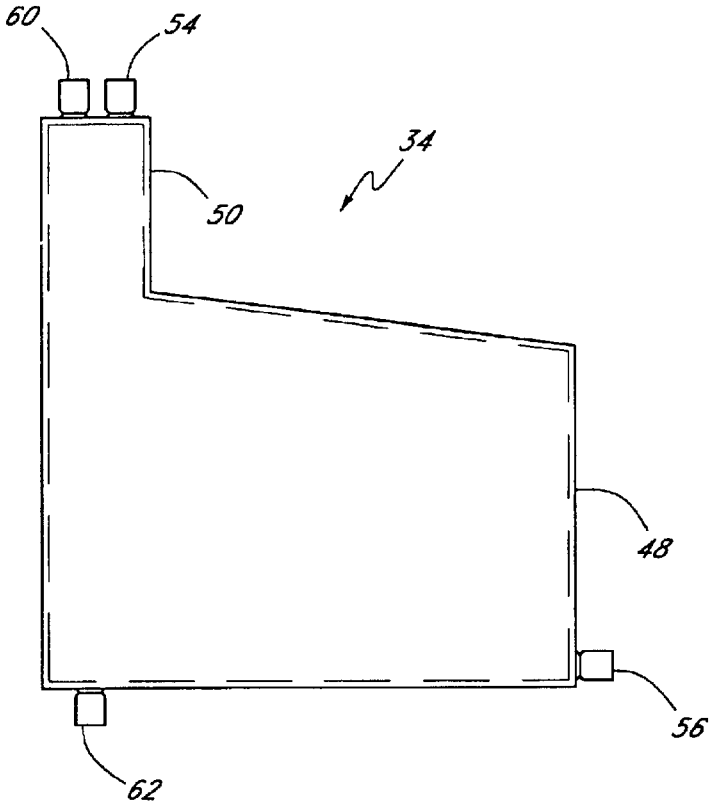
FIG. 2 is a front elevational view of one of the vessels of the apparatus of FIG. 1.
Figure 3:
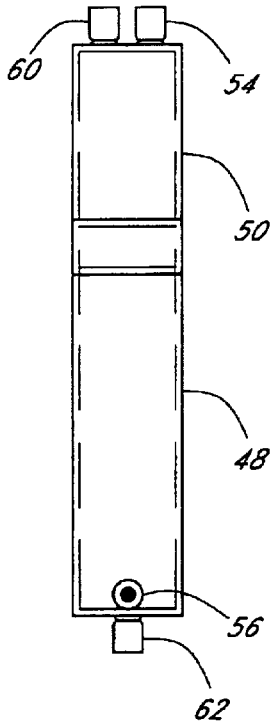
FIG. 3 is a right side elevational view of the vessel of FIG. 2.

In the apparatus of FIG. 1, the first fluid source 24 is connected by a first fluid line 32 to a first vessel 34. The second fluid source 28 is connected by a second fluid line 40 to a second vessel 44. In the illustrated embodiment, each of the first and second vessels 34, 44 generally comprises a lower body portion 48 and a neck portion 50 that extends upwardly from the body 48, preferably at one side of the body 48, as best illustrated in FIGS. 2–4. A fluid inlet 54 is provided near a top of the neck 50, and a fluid outlet 56 is provided near a bottom of the body portion 48. The first and second fluid lines 32, 40 are connected to the fluid inlets 54.

Each of the vessels 34, 44 preferably includes an upper sight tube port 60 near the top of the neck 50, and a lower sight tube port 62 near the bottom of the body portion 48. A sight tube 66 preferably is connected between the upper and lower sight tube ports 60, 62, as illustrated schematically in FIG. 1. A vent opening 70 (see FIG. 4) preferably is also provided near the top of the neck 50.

In the illustrated embodiment, each of the sight tubes 66 comprises a tubular fluid conduit 74 having an upper end connected to the upper sight tube port 60 and a lower end connected to the lower sight tube port 62. As is well known in the art, fluid flows out of the lower sight tube port 62 and into the conduit 74 as the vessel 34, 44 is filled with fluid. The height of the fluid column in the sight tube 66 indicates the level of the fluid in the vessel 34, 44. Based on the dimensions of the vessel 34, 44, the volume of the fluid in the vessel 34, 44 can then be determined.

Preferably, the height of the fluid column in the sight tube 66 is sensed by an optical sensor(s) 65. The optical sensor 65 sends a signal to a programmable controller 75, which communicates with various pumps and/or valves in the apparatus. In the simplified schematic of FIG. 1, a single pump 80 and a single valve 82 are provided in each of the first and second fluid lines 32, 40 between the fluid sources 24, 28 and the vessels 34, 44.

Optical sensors are well known in the art and can be purchased from a number of different suppliers, including Omron Electronics, Inc., of Schaumburg, Ill. The precision of a typical optical sensor in sensing the height of a fluid column in a sight tube (and, thus, the fluid level in a vessel to which the sight tube is attached) is about ±1 mm of fluid height at 99 percent confidence. Accordingly, given the limited precision of such sensors, as the volume of fluid per unit height in a vessel is decreased, the precision with which it is possible to measure the total volume of fluid in the vessel is increased.

In order to decrease the volume of fluid per unit height in a vessel, and thus increase the precision with which the total volume of fluid in the vessel can be determined, the cross-sectional area of the vessel must be decreased. As the cross-sectional area of the vessel is decreased, however, the height of the vessel must be increased to maintain the same total volume of the vessel. This can be problematic, because the maximum height of the vessel is typically constrained by the environment in which the vessel is located.

Each of the vessels 34, 44 of the apparatus of FIG. 1 comprises a body portion 48 having relatively large cross-sectional area and a neck portion 50 having a smaller cross-sectional area. Preferably, the cross-sectional area of the neck portion 50 of each of the vessels 34, 44 is less than about one-third the cross-sectional area of the body portion 48. In the illustrated embodiment, the cross-sectional area of the neck portion 50 of each vessel 34, 44 is about 20 percent that of the body portion 48.

When the fluid level in the vessel 34, 44 is below the neck portion 50 thereof, the precision with which the total volume of fluid in the vessel 34, 44 can be determined is relatively low, due to the relatively large cross-sectional area of the body portion 48 and the limited precision of the optical sensor 65. As the vessel 34, 44 is filled and the fluid level rises into the neck portion 50, however, it is possible to more precisely determine the total volume of fluid in the vessel 34, 44, assuming the volume of the body portion 48 of the vessel 34, 44 is known. Because the cross-sectional area of the neck 50 is relatively small, the fluid level in the neck 50, and thus the height of the fluid column in the sight tube 66, rises or falls significantly as the volume of fluid in the vessel 34, 44 is increased or decreased. As a result, the volume of fluid in the vessel 34, 44 can be sensed more precisely by the optical sensor 65. At the same time, because of the relatively large cross-sectional area of the body 48 of the vessel 34, 44, the total volume of the vessel 34, 44 can be substantial without requiring that the height of the vessel 34, 44 be excessive.

With reference again to FIG. 1, in operation, the controller 75 opens the valve 82 and activates the pump 80 to pump the first fluid through the first fluid line 32 from the first fluid source 24 to the first vessel 34. The fluid level in the vessel 34 rises through the body 48 of the vessel 34 and into the neck 50. As the vessel 34 is filled, the fluid column in the sight tube 66 rises. The optical sensor 65 senses the height of the fluid column in the sight tube 66. When the column reaches a predetermined height indicating that the desired amount of fluid is in the vessel 34, the sensor sends a signal to the controller 75 to close the valve 82 and deactivate the pump 80.

In a similar manner, the controller 75 opens the valve 82 and activates the pump 80 of the second fluid line 40 to pump the second fluid from the second fluid source 28 to the second vessel 44. The fluid level in the second vessel 44 similarly rises through the body 48 of the vessel 44 and into the neck 50. As the vessel 44 is filled, the fluid column in the sight tube 66 rises. The optical sensor 65 senses the height of the fluid column in the sight tube 66. When the column reaches a predetermined height indicating that the desired amount of fluid is in the vessel 44, the sensor 65 sends a signal to the controller 75 to close the valve 82 and deactivate the pump 80.

In the arrangement of FIG. 1, each of the first and second vessels is connected to a mix chamber 100 or storage chamber by a fluid line 102. The fluid lines 102 are connected to the fluid outlets 56 (see FIGS. 2–3) of the vessels 34, 44. When the vessels 34, 44 are filled to the desired levels (taking into account the amount of fluid in the fluid lines 102 between the vessels 34, 44 and the mix chamber 100), the controller 75 opens a valve 108 in each of the fluid lines 102 and delivers the precisely measured contents of vessels 34, 44 into the mix chamber 100. Depending on the particular arrangement of the apparatus, additional pumps may be necessary to pump the fluids through the fluid lines 102 to the mix chamber.

The mix chamber 100 may include a mechanical mixer (not shown) to stir the contents of the mix chamber 100 and prevent the mixture from stagnating or separating. In the illustrated embodiment, a recirculation line 110 is provided for such purpose. The mixture exits the mix chamber 100 and is pumped through the recirculation line 110 and back into the mix chamber 100. In the illustrated arrangement, a three-way valve 118 is provided in the recirculation line 110 so that a portion of the mixture can be diverted to the workpiece (not shown) for use in the CMP process.

It is to be understood that the apparatus 20 illustrated schematically in FIG. 1 is merely exemplary. Those skilled in the art will recognize that, depending on the particular process to be carried out, alternative arrangements may include a greater or lesser number of vessels and accommodate additional or different fluids. In addition, depending on the precision with which it is necessary to measure the various components of the chemical mixture, only certain of the vessels may have the large cross-sectional body and smaller cross-sectional area neck configuration of the vessels of the apparatus of FIG. 1.

Figure 5:
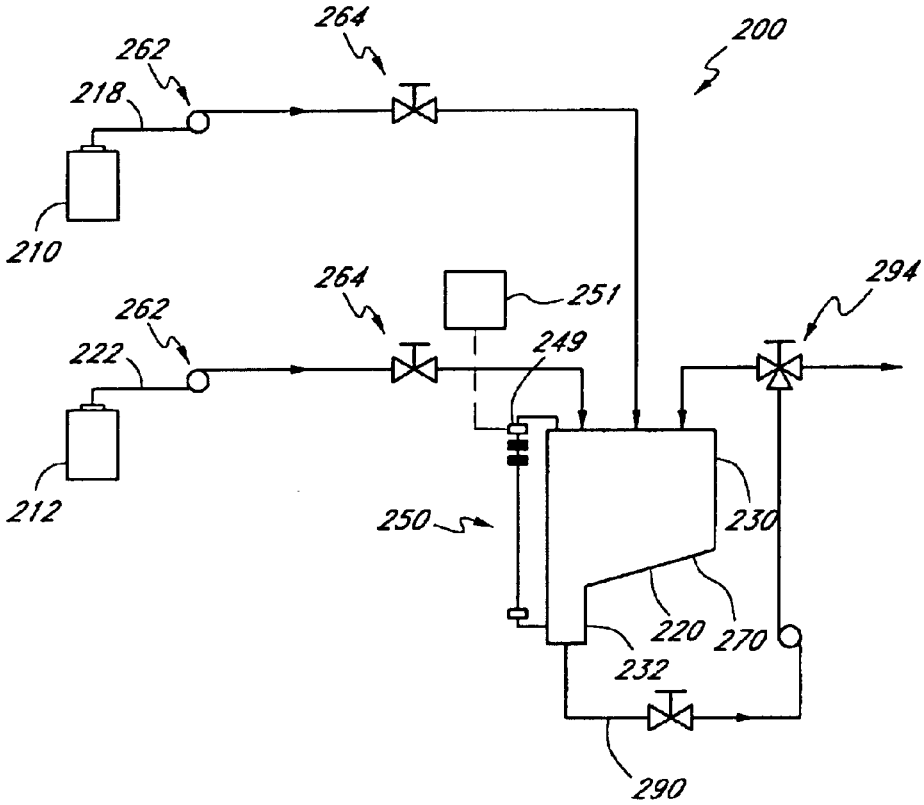
FIG. 5 is a simplified schematic view of a second exemplary apparatus for mixing chemical slurries for chemical mechanical polishing of a workpiece.

With reference now to FIG. 5, a simplified schematic view of a second exemplary apparatus 200 for preparing chemical mixtures is illustrated. In the illustrated embodiment, the apparatus 200 comprises a first fluid source 210 and a second fluid source 212. Again, depending on the surface material to be polished, the first fluid source 210 may comprise, for example, a slurry containing a suspension of electrically charged silica particles. The second fluid source 212 may comprise, for example, deionized water.

In the arrangement illustrated in FIG. 5, the first fluid source 210 is connected by a first fluid line 218 to a mix vessel 220. The second fluid source 212 is connected by a second fluid line 222 to the mix vessel 220. As best illustrated in FIGS. 6–9, the mix vessel 220 generally comprises a body portion 230 and a neck portion 232 that extends downwardly from the body 230, preferably at one side of the body 230. A pair of fluid inlets 236 are provided near a top of the body 230. A fluid outlet 238 is provided near a bottom of the neck 232. The first and second fluid lines 218, 222 (FIG. 5) are connected to the fluid inlets 236 of the vessel 220.

The vessel 220 preferably includes an upper sight tube port 244 near the top of the neck 232, and a lower sight tube port 246 near the bottom of the body portion 230. A sight tube 250 preferably is connected between the first and second sight tube ports 244, 246, as illustrated schematically in FIG. 5. A vent opening (not shown) and a recirculation inlet 256 preferably are also provided near the top of the body 230.

Fluid flows out of the lower sight tube port 246 and into the sight tube 250 as the vessel 220 is filled with fluid. The height of the fluid column in the sight tube 250 indicates the level of the fluid in the vessel 220. Preferably, the height of the fluid column in the sight tube 250 is sensed by an optical sensor 249, which sends a signal to a programmable controller 251. The controller 251 communicates with various pumps and/or valves in the apparatus. In the simplified schematic of FIG. 5, a single pump 262 and a single valve 264 are provided in each of the fluid lines 218, 222 between the fluid sources 210, 212 and the vessel 220.

Figure 7:
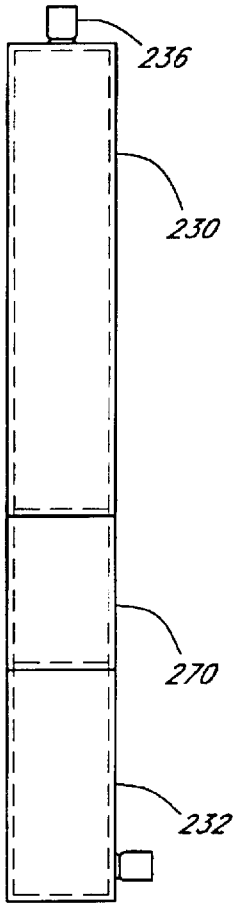
FIG. 7 is a right side elevational view of the vessel of FIG. 6.
Figure 6:
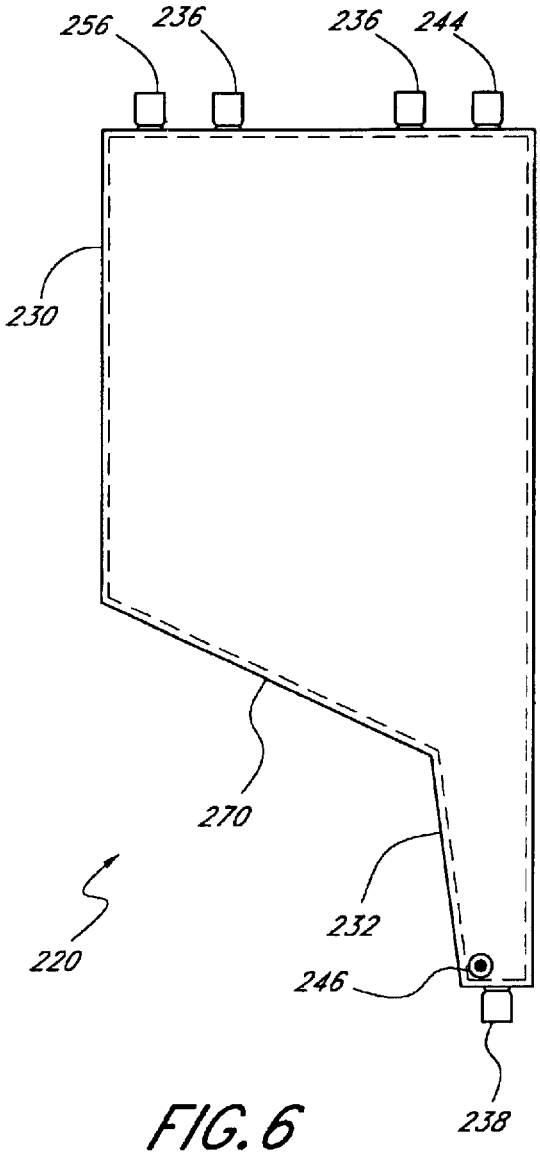
FIG. 6 is a rear elevational view of one of the vessels of the apparatus of FIG. 5.
Figure 8:
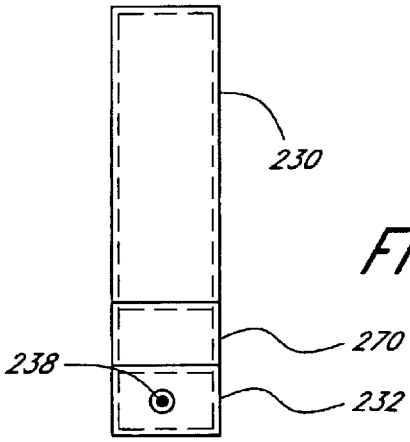
FIG. 8 is a bottom plan view of the vessel of FIG. 6.

As illustrated in FIGS. 6–8, the body portion 230 of the vessel 220 has a relatively large cross-sectional area. The neck portion 232 has a smaller cross-sectional area. Preferably, the cross-sectional area of the neck portion 232 is less than about one-third that of the body portion 230. In the illustrated embodiment, the cross-sectional area of the neck portion 232 of the vessel 220 is about 21 percent that of the body portion 230.

The vessel 220 preferably includes a transitional region 270 between the body portion 230 and the neck 232, as best illustrated in FIG. 6. Preferably, the cross-sectional area of the transitional region 270 decreases progressively from the body portion 230 to the neck 232 to facilitate fluid drainage from the vessel 220. In the vessel 220 of FIGS. 6–8, the cross-sectional area of the neck 232 similarly decreases from the transitional region 290 to the bottom of the neck 232 to facilitate drainage from the vessel 220.

With reference to FIG. 5, in operation, the controller 251 opens the valve 264 and activates the pump 262 to the first fluid through the fluid line 218 from the first fluid source 210 to the vessel 220. The fluid rises into the neck portion 232 of the vessel 220. Because of the relatively small cross-sectional area of the neck portion 232, the fluid level in the neck 232, and thus the height of the fluid column in the sight tube 250, rises significantly as the volume of fluid in the neck 232 is increased. The volume of the first fluid in the neck 232 can thus be precisely determined by the optical sensor 249. When the fluid column reaches a predetermined height indicating that a desired volume of fluid is in the neck portion 232, the sensor 249 sends a signal to the controller 251 to close the valve 264 and deactivate the pump 262.

The controller 251 then opens the valve 264 and activates the pump 262 of the second fluid line 222 to pump the second fluid from the second fluid source 212 to the vessel 220. The fluid level in the vessel 220 rises through the remaining part of the neck 232 and into the body portion 230 of the vessel 220. As the vessel 220 is filled, the fluid column in the sight tube 250 rises. The optical sensor 249 senses the height of the fluid column in the sight 250 tube. When the column reaches a predetermined height, the sensor 249 sends a signal to the controller 251 to close the valve 264 and deactivate the pump 262.

The vessel 220 illustrated in FIGS. 5–8 is particularly advantageous when a desired mixture includes a substantially greater volume of one component than another component. The smaller volume component is first delivered to the vessel 220 to fill the neck 232 of the vessel 220. Because of the smaller cross-sectional area of the neck 232, the precise volume of the smaller volume component in the neck 232 can be precisely determined. The larger volume component, which need not be measured as precisely, can then be delivered to the vessel 220 to fill the body 230 of the vessel 220.

In the arrangement of FIG. 5, a recirculation line 290 is provided to prevent the mixture from stagnating. The mixture exits the vessel 220 through the fluid outlet 238 and is pumped through the recirculation line 290 and back into the vessel 220 through the recirculation inlet 256. In the illustrated arrangement, a three-way valve 294 is provided in the recirculation line 290 so that a portion of the mixture can be diverted to the workpiece (not shown) for use in the CMP process.

It is to be understood that the apparatus illustrated in FIG. 5, too, is merely exemplary. Those skilled in the art will recognize that, depending on the particular process to be carried out, alternative arrangements may include a greater of vessels and accommodate additional or different fluids. In addition, depending on the precision with which it is necessary to measure the various components of the chemical mixture, only certain of the vessels may have the large cross-sectional body and smaller cross-sectional area neck configuration of the vessel of the apparatus of FIG. 5.

Although the invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof Thus, it is intended that the scope of the present invention herein disclosed should not be limited by the particular disclosed embodiments described above, but should be determined only by a fair reading of the claims that follow.

What is claimed is:

1. A method of preparing a fluid mixture comprising predetermined amounts of two or more fluids, the method comprising the steps of:

providing a first vessel comprising a body and a neck extending upwardly from said body, said neck having a smaller cross-sectional area than said body;

delivering a first fluid to said first vessel to fill said body and at least a portion of said neck;

reading a sight tube connected to said first vessel, said sight tube indicating an amount of said first fluid in said first vessel;

discontinuing said delivery of said first fluid when said sight tube indicates that a predetermined amount of said first fluid is in said first vessel;

providing a second vessel;

delivering a second fluid to said second vessel;

reading a sight tube connected to said second vessel, said sight tube indicating an amount of said second fluid in said second vessel;

discontinuing said delivery of said second fluid when said sight tube indicates that a predetermined amount of said second fluid is in said second vessel;

delivering said predetermined amounts of said first and second fluids to a mix chamber; and mixing said predetermined amounts of said first and second fluids in said mix chamber.

2. The method of claim 1, wherein said second vessel comprises a body and a neck extending upwardly from said body, said neck having a smaller cross-sectional area than said body, and said delivering of said second fluid to said second vessel comprises filling said body and at least a portion of said neck of said second vessel.

3. A chemical delivery apparatus, comprising:

a first vessel comprising a body and a neck extending upwardly from said body, said neck having a smaller cross-sectional area than said body, a fluid inlet near a top of said neck, a fluid outlet near a bottom of said body, a first sight tube port near the top of said neck, a second sight tube port near the bottom of said body, and a vent opening near the top of said neck;

a first fluid source selectively communicating with said first vessel through said fluid inlet of said first vessel;

a sight tube connected between said first and second sight tube ports of said first vessel, said sight tube indicating an amount of fluid in said first vessel;

a second vessel comprising a fluid inlet and a fluid outlet;

a second fluid source selectively communicating with said second vessel through said fluid inlet of said second vessel; and a mix chamber selectively communicating with said first and second vessels through said fluid outlets of said first and second vessels.

4. The apparatus of claim 3, wherein a cross-sectional area of said neck is less than about one-third that of said body.

5. The apparatus of claim 3, further comprising an optical sensor, said optical sensor sensing a height of a fluid column in said sight tube.

6. The apparatus of claim 5, further comprising a programmable controller in communication with said optical sensor.

7. A method of preparing a fluid mixture comprising predetermined amounts of two or more fluids, the method comprising the steps of:

providing a vessel comprising a body and a neck extending downwardly from said body, said neck having a smaller cross-sectional area than said body;

delivering a first fluid to said vessel to fill a portion of said neck;

reading a sight tube connected to said vessel, said sight tube indicating an amount of said fluid in said vessel;

discontinuing said delivery of said first fluid when said sight tube indicates that a predetermined amount of said first fluid is in said vessel;

delivering a second fluid to said vessel to fill a remaining portion of said neck and at least a portion of said body;

reading said sight tube;

discontinuing said delivery of said second fluid when said sight tube indicates that a predetermined amount of said second fluid is in said vessel; and delivering said predetermined amounts of said first and second fluids to a storage chamber.

8. The method of claim 7, wherein said reading comprises sensing a height of a fluid column in said sight tube with an optical sensor.

9. A chemical delivery apparatus, comprising:

a vessel comprising a body and a neck extending downwardly from said body, said neck having a smaller cross-sectional area than said body, a first fluid inlet near a top of said body, a second fluid inlet near a top of said body, a fluid outlet near a bottom of said neck, a first sight tube port near a top of body, a second sight tube port near a bottom of said neck, and a vent opening near a top of said body;

a first fluid source selectively communicating with said vessel through said first fluid inlet;

a second fluid source selectively communicating with said vessel through said second fluid inlet;

a sight tube connected between said first and second sight tube ports, said sight tube indicating an amount of fluid in said first vessel; and a storage chamber selectively communicating with said vessel through said fluid outlet.

10. The apparatus of claim 9, wherein a cross-sectional area of said neck is less than about one-third that of said body.

11. The apparatus of claim 9, wherein said vessel further comprises a transitional region between said body and said neck, said transitional region having a cross-sectional area that decreases progressively from said body to said neck.

12. The apparatus of claim 11, wherein a cross-sectional area of said neck decreases from said transitional region to the bottom of said neck.

* * * * *